US009774130B2

(12) United States Patent
Zhao et al.

(10) Patent No.: US 9,774,130 B2
(45) Date of Patent: Sep. 26, 2017

(54) WATERPROOF ELECTRICAL CONNECTOR

(71) Applicant: FOXCONN INTERCONNECT TECHNOLOGY LIMITED, Grand Cayman (KY)

(72) Inventors: Jun Zhao, HuaiAn (CN); Guang-Xin Gu, HuaiAn (CN); Jing-Jie Guo, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/368,704

(22) Filed: Dec. 5, 2016

(65) Prior Publication Data

US 2017/0162976 A1 Jun. 8, 2017

(30) Foreign Application Priority Data

Dec. 3, 2015 (CN) ..... 2015 1 0875859

(51) Int. Cl.

| | |
|---|---|
| ***H01R 24/00*** | (2011.01) |
| ***H01R 13/52*** | (2006.01) |
| ***H01R 24/60*** | (2011.01) |
| ***H01R 13/405*** | (2006.01) |
| ***H01R 12/71*** | (2011.01) |
| ***H01R 4/02*** | (2006.01) |
| *H01R 107/00* | (2006.01) |

(52) U.S. Cl.

CPC ..... *H01R 13/5216* (2013.01); *H01R 4/02* (2013.01); *H01R 12/716* (2013.01); *H01R 13/405* (2013.01); *H01R 24/60* (2013.01); *H01R 2107/00* (2013.01)

(58) Field of Classification Search

CPC ..... H01R 23/02; H01R 24/60; H01R 24/62
USPC ..... 439/589, 660, 607.4, 936
See application file for complete search history.

(56) References Cited

U.S. PATENT DOCUMENTS

| | | | | |
|---|---|---|---|---|
| 8,801,463 | B2 * | 8/2014 | Tan | H01R 13/5202 439/607.04 |
| 8,827,742 | B2 * | 9/2014 | Wang | H01R 24/68 439/569 |
| 9,197,104 | B2 * | 11/2015 | Madsen | H02K 1/20 |
| 9,278,365 | B2 * | 3/2016 | Banco | B05B 7/2491 |
| 9,379,499 | B2 * | 6/2016 | Miyoshi | H01R 24/60 |
| 9,385,481 | B2 * | 7/2016 | Chung | H01R 13/6581 |
| 9,553,410 | B2 * | 1/2017 | Zhao | H01R 13/6581 |

(Continued)

FOREIGN PATENT DOCUMENTS

CN 204315771 U 5/2015

*Primary Examiner* — Phuong Dinh
(74) *Attorney, Agent, or Firm* — Wei Te Chung; Ming Chieh Chang

(57) ABSTRACT

An electrical connector with a terminal module enclosed within an insulative shield wherein the terminal module includes a plurality of terminals embedded within an insulative main body. The insulative main body forms a rear mounting standing part and a front mating tongue part extending forwardly from the rear mounting standing part. The insulative shield forms a rearward step against a forward shoulder of the base portion so as to prevent further forward movement of the base portion relative to the insulative shield. The insulative main body forms a protrusion and the insulative shield forms a securing hole to receive said protrusion for securing the insulative shield and the terminal module together.

3 Claims, 11 Drawing Sheets

(56) References Cited

U.S. PATENT DOCUMENTS

| | | | | |
|---|---|---|---|---|
| 2014/0113497 | A1* | 4/2014 | Wang | H01R 13/52<br>439/660 |
| 2015/0200504 | A1 | 7/2015 | Little et al. | |
| 2016/0104957 | A1* | 4/2016 | Kim | H01R 13/6581<br>439/78 |

* cited by examiner

WATERPROOF ELECTRICAL CONNECTOR

BACKGROUND OF THE INVENTION

1. Field of the Invention

The present invention relates to an electrical connector, and particularly to a USB (Universal Serial Bus) type C connector with a reinforced structure thereof by an insulative shell with the unitarily formed mounting legs in place of a metallic shell.

2. Description of Related Art

USB type C specification was issue on Aug. 11, 2014, which and hundreds of designs are made based upon. The Chinese patent CN204315771 discloses a USB Type C receptacle connector essentially in compliance with the corresponding specification. Anyhow, practically on one hand because the metallic exterior shield is formed by sheet metal, thus inevitably having s a seam after forming and the corresponding inferior waterproof character and shielding effect. On the other hand, the metallic shield may electrically interfere with the antenna if the antenna part is located too close to the connector. Moreover, the metallic shield may tend to be shorted if some dusts improperly touch and link the metallic shield and other electronic component.

An improved electrical connector without the aforementioned shortcomings, is desired.

SUMMARY OF THE INVENTION

Accordingly, the object of the present invention is to provide an electrical connector with a terminal module enclosed within an insulative shield wherein the terminal module includes a plurality of terminals embedded within an insulative base. The insulative main body forms a rear mounting standing part and a front mating tongue part extending forwardly from the rear mounting standing part. The insulative shield forms a rearward step against a forward shoulder of the base portion so as to prevent further forward movement of the insulative main body relative to the insulative shield. One of the insulative shield and the insulative main body forms a locking lug engaged within a locking recess in the other of the insulative shield and the insulative main body so as to prevent rearward movement of the insulative main body relative to the insulative shield. The insulative shield further includes a pair of mounting legs which are located above the bottom face of the insulative shield and located by two lateral sides of the insulative main body.

Other objects, advantages and novel features of the invention will become more apparent from the following detailed description when taken in conjunction with the accompanying drawings.

DETAILED DESCRIPTION OF THE PREFERRED EMBODIMENT

Figure 1:
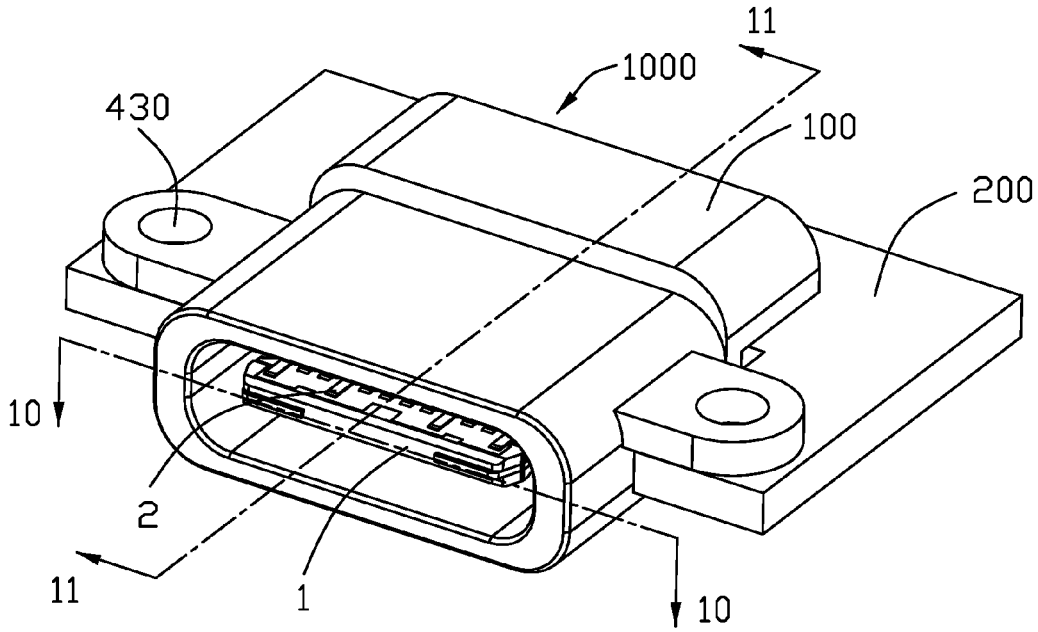
FIG. 1 is a front downward assembly perspective view of an electrical connector assembly including an electrical connector mounted on the external PCB.
Figure 2:
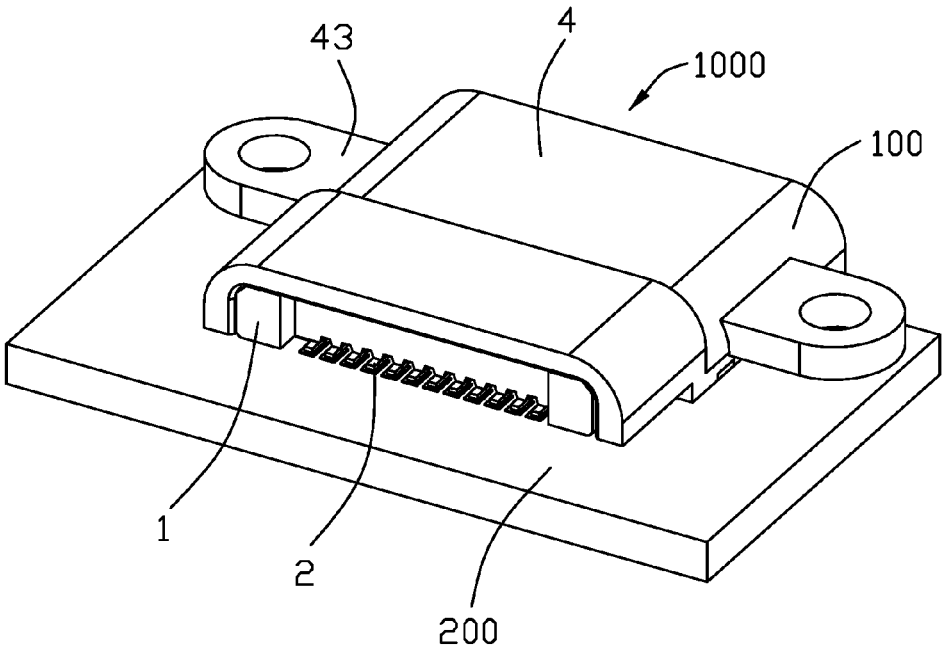
FIG. 2 is a rear downward assembly perspective view of the electrical connector assembly FIG. 1.
Figure 3:
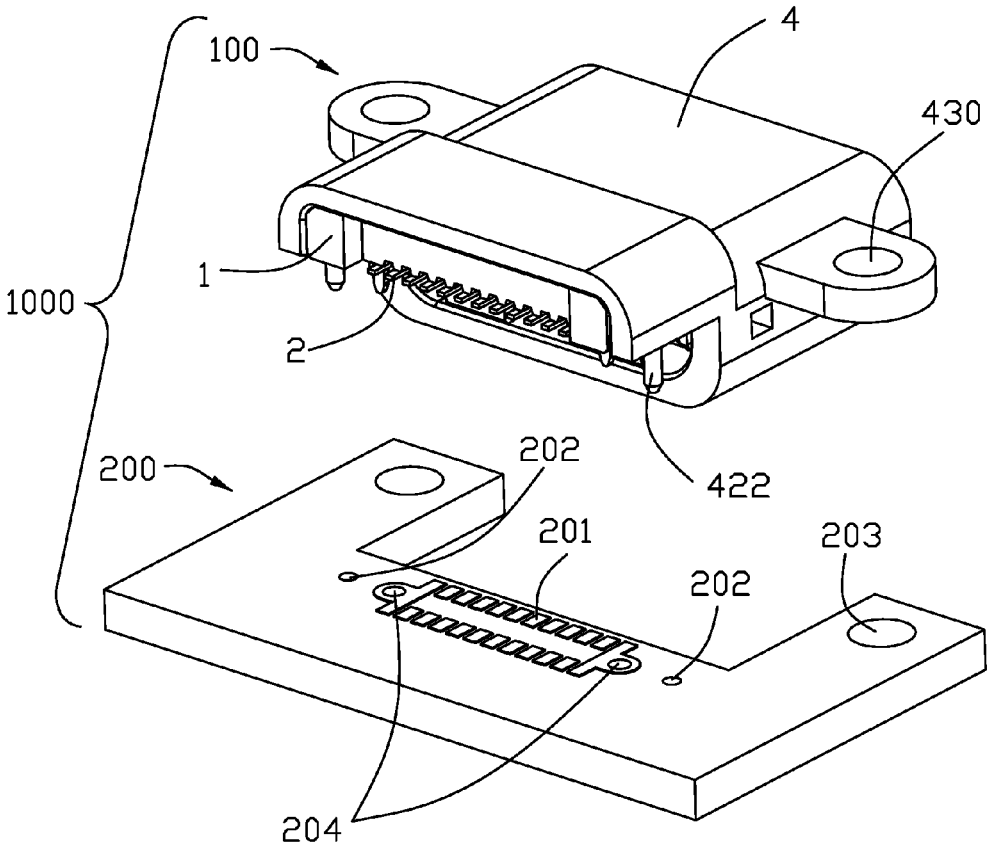
FIG. 3 is a rear downward exploded perspective view of the electrical connector assembly of FIG. 1.
Figure 4:
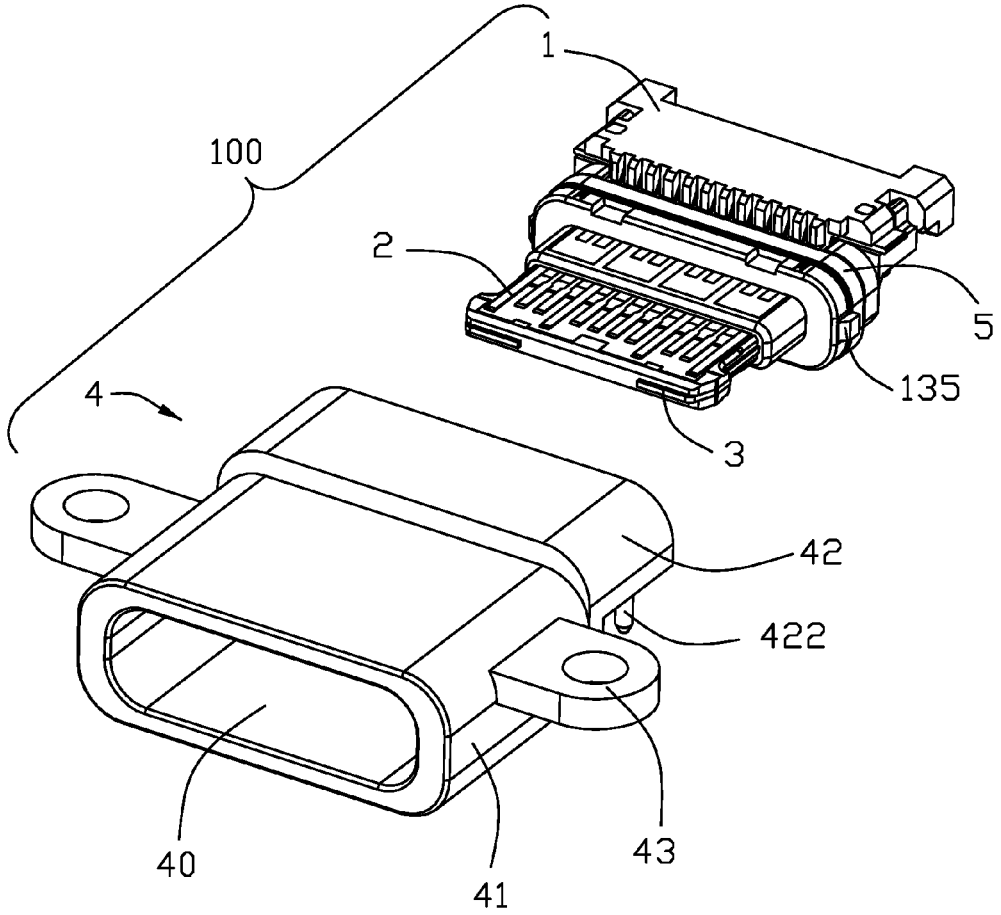
FIG. 4 is a front downward exploded perspective view of the electrical connector of the electrical connector assembly of FIG. 1.
Figure 5:
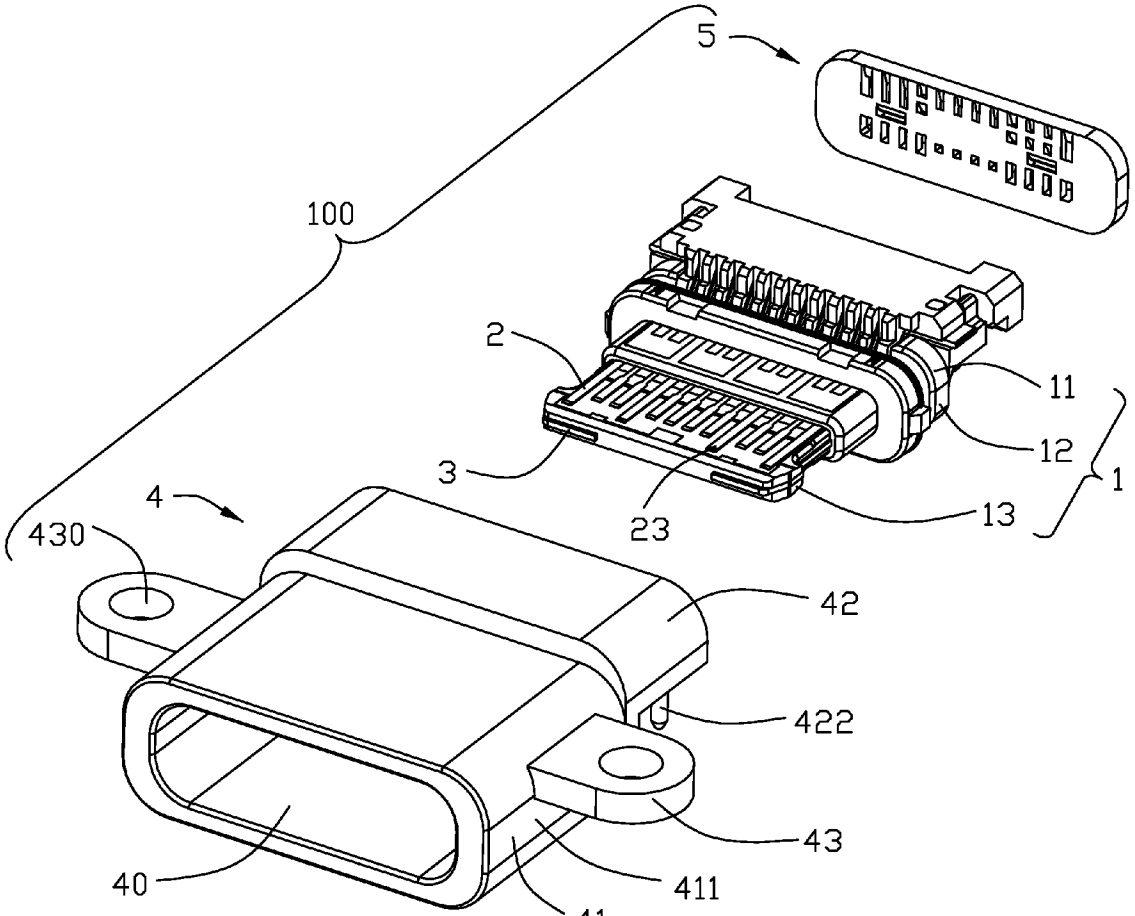
FIG. 5 is a front downward further exploded perspective view of the electrical connector of FIG. 4.
Figure 6:
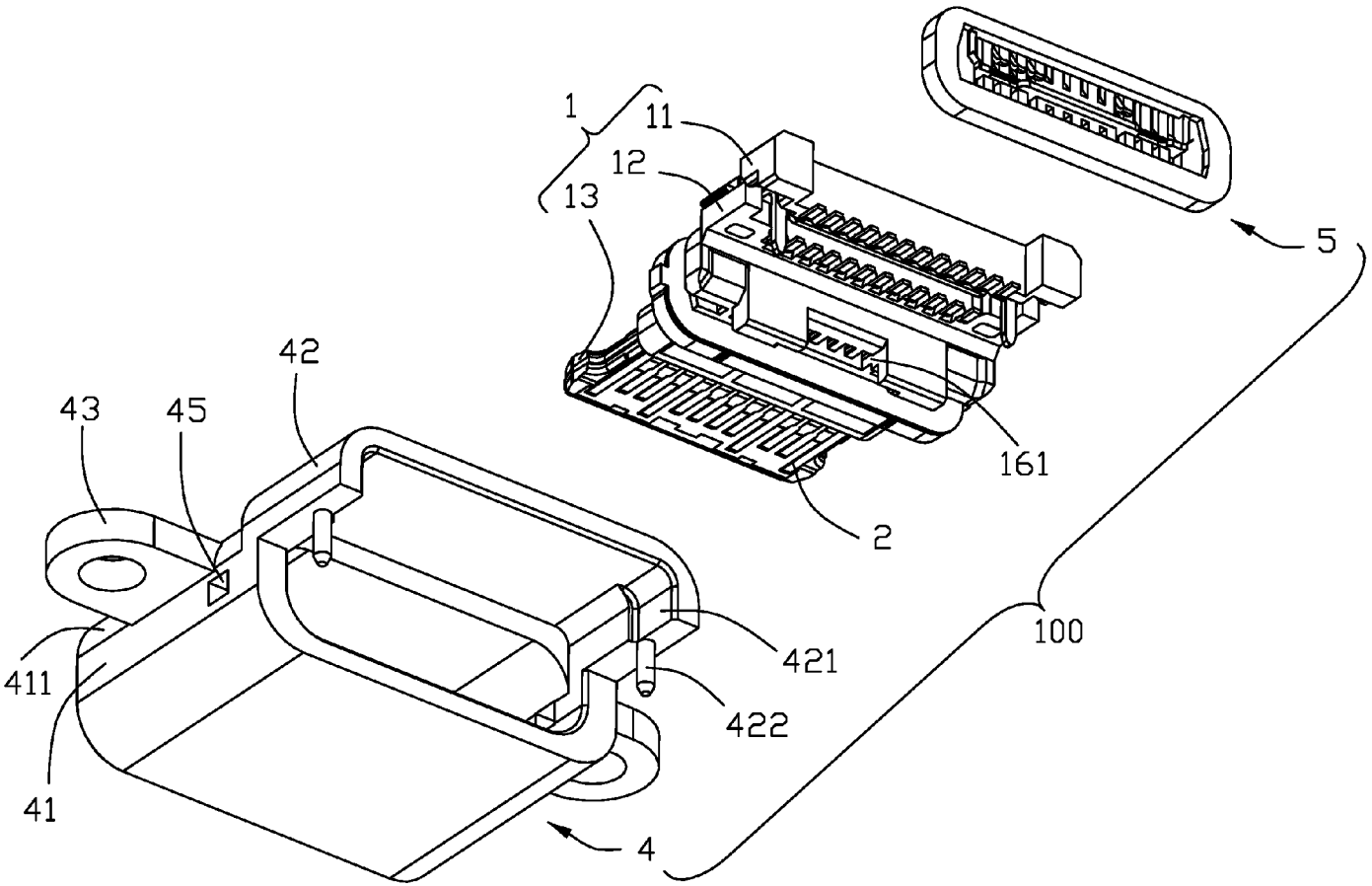
FIG. 6 is a rear upward exploded perspective view of the electrical connector of FIG. 5.
Figure 7:
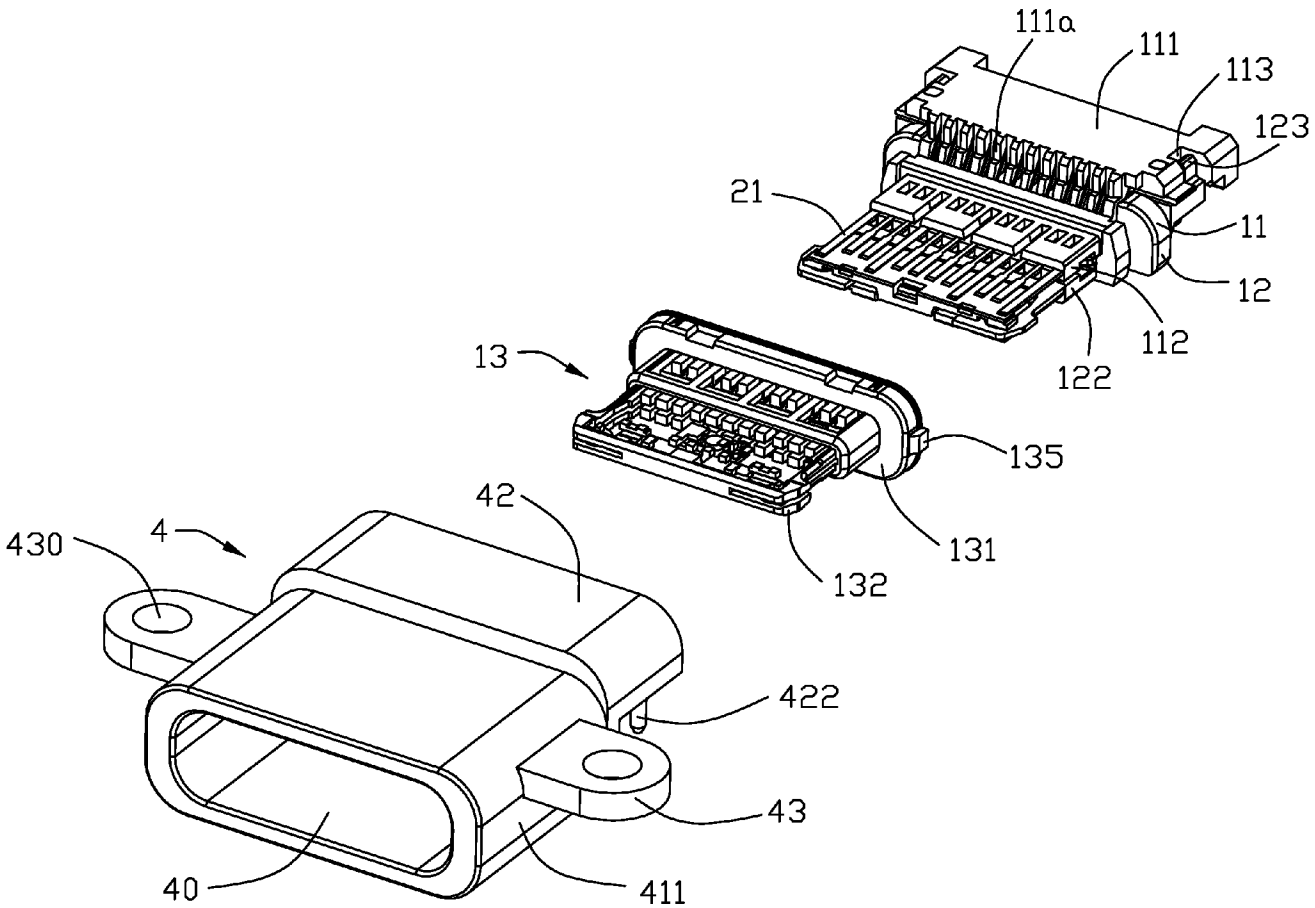
FIG. 7 is a front downward further exploded perspective view of the electrical connector of FIG. 5.
Figure 8:
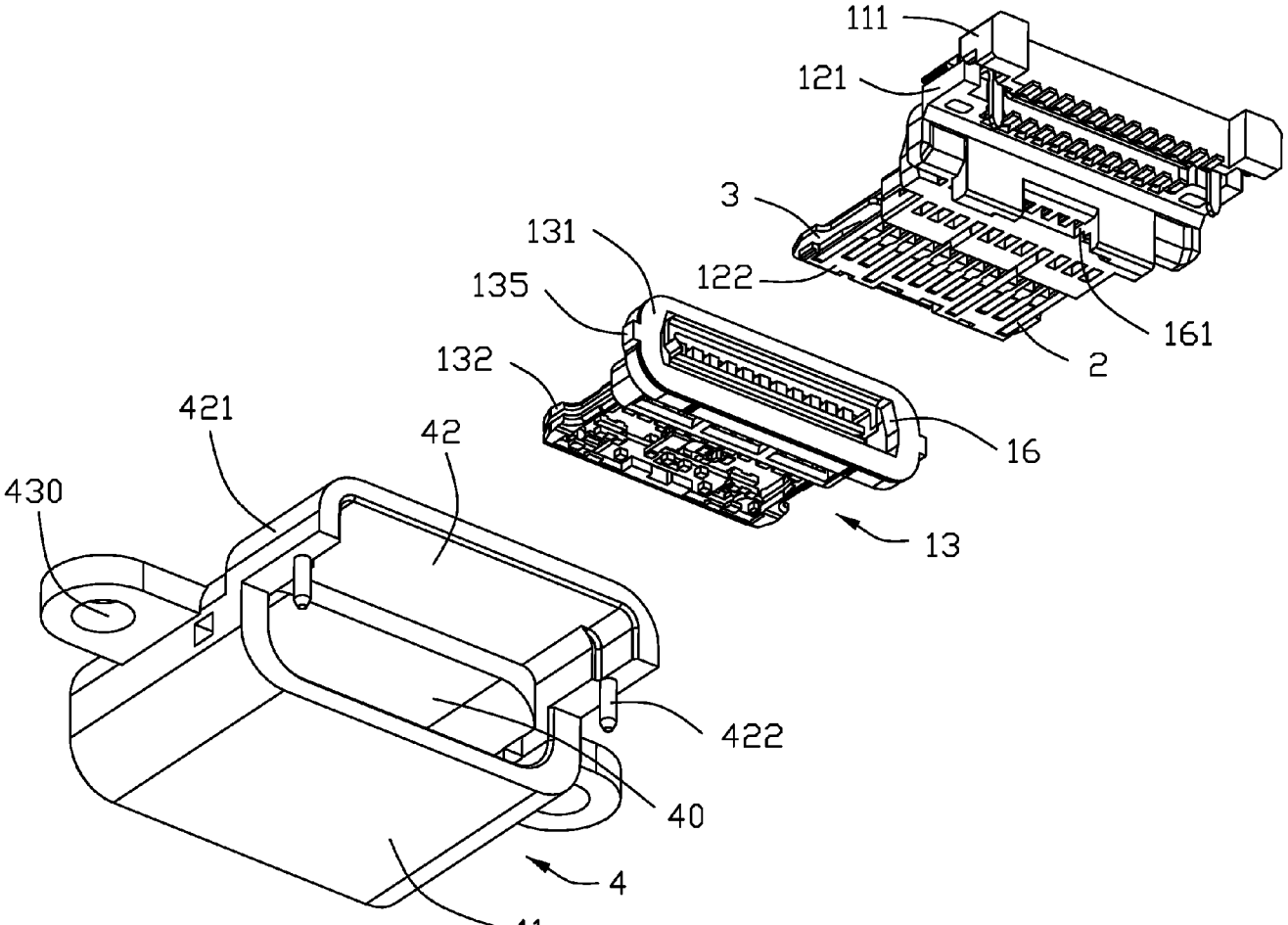
FIG. 8 is a rear upward exploded perspective view of the electrical connector of FIG. 7.
Figure 9:
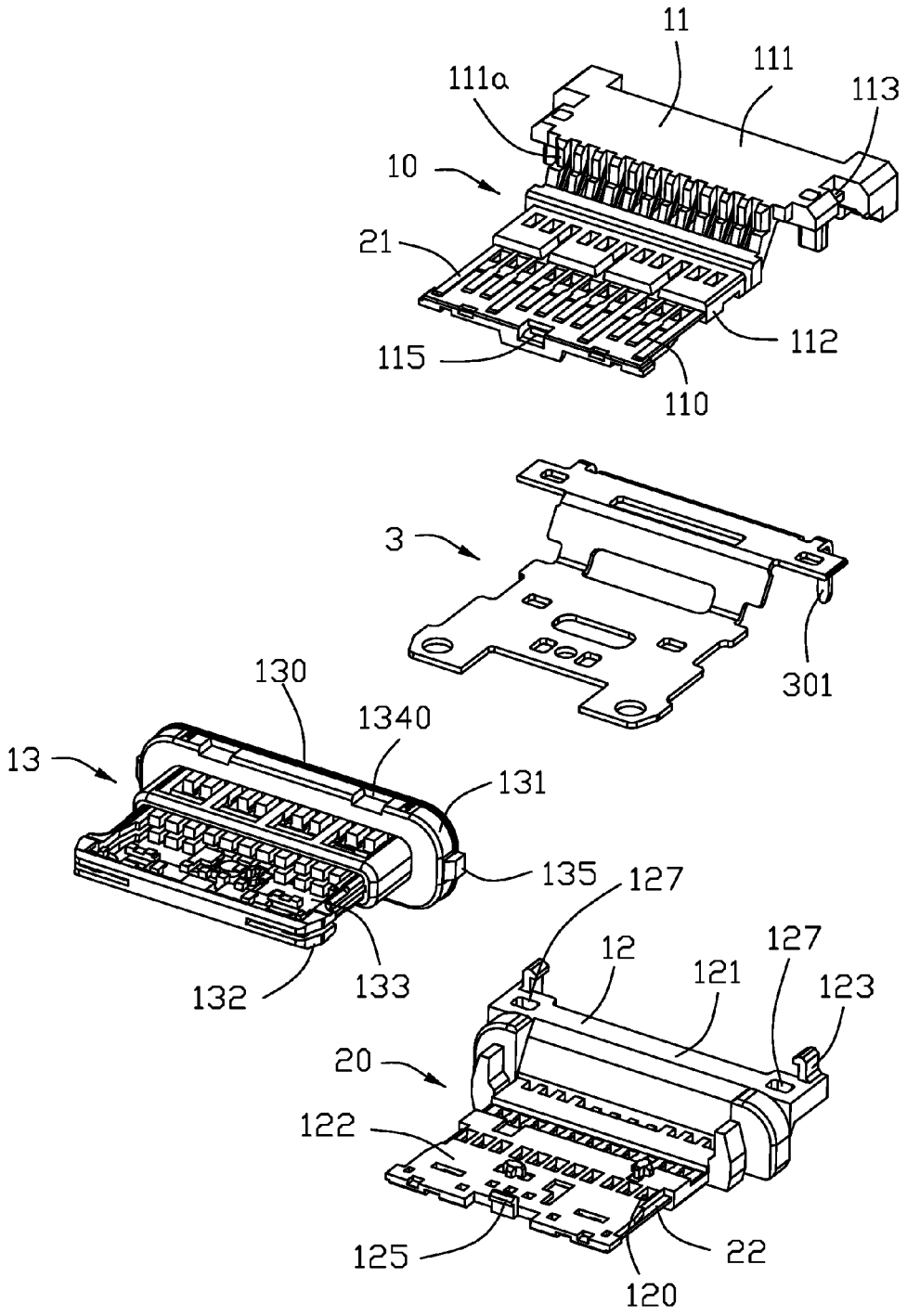
FIG. 9 is a front exploded perspective view of the terminal module of the electrical connector of FIG. 8.
Figure 10:
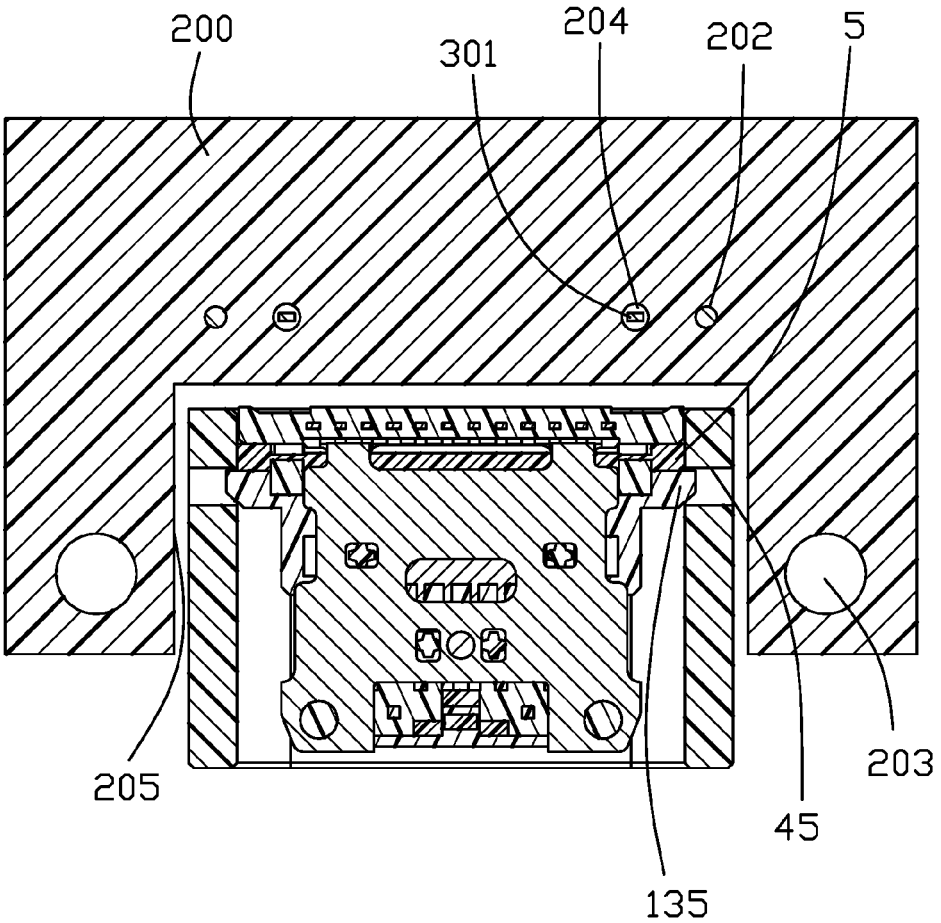
FIG. 10 is a cross-sectional view of the electrical connector of FIG. 1 along a horizontal plane.
Figure 11:
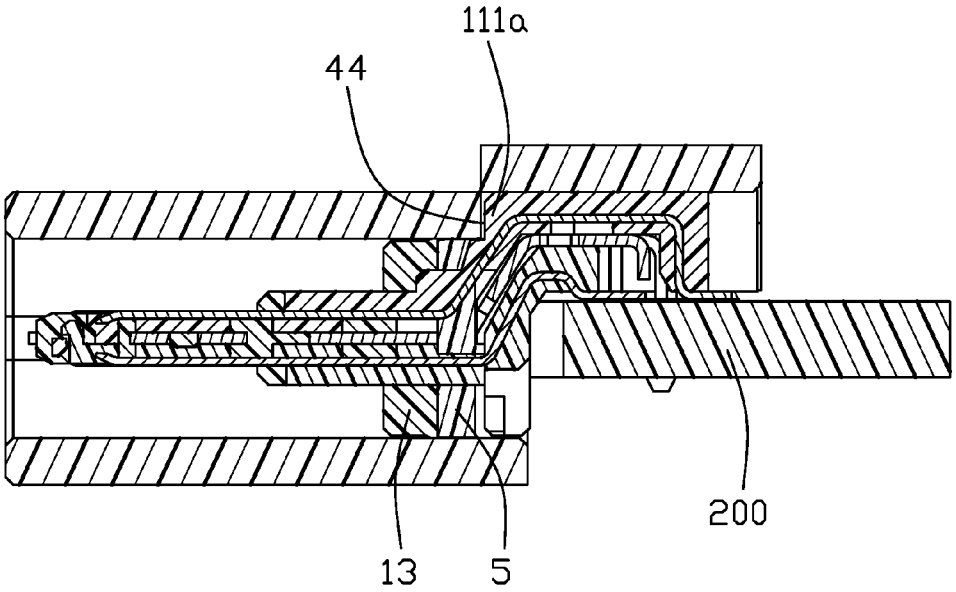
FIG. 11 is another cross-sectional view of the electrical connector of FIG. 1 along a vertical plane.

Reference will now be made in detail to the preferred embodiment of the present invention. Referring to FIGS. 1 to 11, an electrical connector assembly 1000 includes an electrical connector 100 mounted upon and within a cutout 205 an external PCB 200 wherein the electrical connector 100 is mated and withdrawn with a complementary plug connector along the front-to-back direction, is mounted to the PCB 200 in a vertical direction perpendicular to the front-to-back direction. A transverse direction is perpendicular to both the front-to-back direction and the vertical direction. The electrical connector includes a terminal module (not labeled) composed of an insulative main body 1, which is essentially composed of a rear mounting standing part (not labeled) and a front mating tongue part (not labeled) extending forwardly from the rear mounting standing part, and a plurality of conductive terminals 2 associated within the insulative main body 1, a metallic shielding plate 3 embedded within the insulative main body 1, a glue or waterproof plate 5 and an insulative shield 4 enclosing the terminal module.

The insulative main body 1 includes a first insulative body 11, a second insulative body 12 and a third insulative body 13. The first insulative body 11 includes a first base portion 111 and a first tongue portion 112 extending from the first base portion 111. A pair of slots 113 are formed in two opposite lateral sides of the first base 111. A notch 115 is formed in a middle region of a front end of the first tongue portion 112. A plurality of first passageways 110 are formed in the first tongue portion 112 to receive the corresponding terminals 2. The insulative body 12 includes a second base portion 121 and a second tongue portion 122 extending from the second base portion 121. A pair of projections 123 are located at two opposite lateral sides of the base portion 121 to be engaged within the corresponding slots 113. A rib 125 is formed on a middle area of the front end of the second tongue portion 122 to be engaged with the corresponding notch 115, and a plurality of second passageways 120 are formed in the second tongue portion 122. The third insulative body 13 includes a third base portion 131 and a third tongue portion 132 extending forwardly from the third base portion 131. The third base portion 131 forms an entrance 130 around the rear end, and the third tongue portion 132 forms a plurality of openings 133. The third base portion 131 includes a pair of locking slots 134 around the upper wall, and protrusions 135 on the lateral walls. The first insulative body 11 and the second insulative body 12 are assembled together in a vertical direction with the shielding plate 3 therebetween, and the third insulative body 13 is formed in the openings 133 via an insert-molding process after the first insulative body 11 and the second insulative body 12 with the associated shielding plate 3 are assembled together. A glue slot 16 is formed behind the third insulative body 13. In a preferred embodiment, the second insulative body 12 forms a glue entrance 161 in communication with the glue slot 16 so as to guide the glue from the glue entrance 161 into the glue slot 16 to form the waterproof plate 5. Notably, the first base portion 111, the second base portion 121 and the third base portion 131 commonly form the aforementioned rear mounting standing part (not labeled), and the first tongue portion 112, the second tongue portion 122 and the third tongue portion 132 commonly form the aforementioned front mating tongue part (not labeled).

The conductive terminals 2 includes a plurality of first conductive terminals 21 and a plurality of second conductive terminals 22 which are respectively exposed upon opposite upper and bottom surfaces of the insulative base 1. The first conductive terminals 21 are insert-molded within the first insulative body 11 to form a first terminal module 10, and the second conductive terminals 22 are insert-molded within the second insulative body 12 to form a second terminals module 20. The first terminal module 10 and the second terminal module 20 are vertically assembled to each other with the shielding plate 3 sandwiched therebetween wherein the rib 125 and the notch 115 are securely coupled with each other, and the slots 113 and the projections 123 are securely coupled with each other. Understandably, in this embodiment the shielding plate 3 is of one unitary piece. Anyhow, the center region of the shielding plate may be removed to have the shielding plate divided into two lateral parts in an alternate embodiment which has less terminals compared with the full-pin design.

The shield 4 made of insulative material via an injection molding process, includes a receiving cavity 40 surrounded by a tubular structure 41, and a base 42 extending rearwardly from the tubular structure 41 and a pair of mounting sections 43 extending outwardly on two opposite lateral sides of the tubular section 41. The insulative main body 1 is received within the receiving cavity 40. The base 42 forms a U-shaped structure including the left and right side walls 421 and the round mounting legs 422 downwardly extending from the left and right side walls 421, respectively. The tubular section 41 includes opposite left and right walls 411 in which the small securing holes 45 are formed to receive the corresponding protrusions 135, respectively, for securing the terminal module to the shield 4. A pair of wings with large securing holes 430 therein, extend outwardly from the left and right walls 411, respectively. In the preferred embodiment, the material of the insulative shield 4 is PA46, i.e., Poly (tetramethylene adipamide), and the thickness of the tubular section 41 is not less than 0.6 mm for meeting the torsion test requirement. In this embodiment, the shield 4 is assembled upon the insulative main body 1 of the terminal module with the glue filled within the glue slot 16 for water-resistance. Alternately, the insulative shield 4 may be overmolded upon the insulative main body 1 of the terminal module with inherent water-resistance without filling the glue therein. It is also noted that the shield 4 forms a rearward step 44 against which a shoulder 111*a* of the first base portion 11 forwardly abuts for positioning the terminal module without further forward movement. It is noted that the waterproof plate 5 is located around a boundary between the tubular section 41 and the base 42.

The PCB 200 includes a plurality of conductive pads 201 for securing the corresponding conductive terminals 2 thereon, the (large) mounting holes 203 aligned with the securing holes 430, the (small) mounting apertures/holes 202 for receiving the corresponding round mounting legs 422, and the soldering holes 204 for receiving the mounting/soldering legs 301 of the shielding plate 3 which first extend through the corresponding through holes 127 of the second insulator body 12. Notably, the mounting holes 203 and the corresponding securing holes 430 may be secured together by corresponding screws (not shown).

Understandably, the first terminals 21 and the second terminals 22 are arranged in a diagonally symmetrical manner as required in the Type C connector, so that a corresponding plug may be inserted into the receptacle connector in a flippable way, i.e., two opposite orientations. Also, the insulative main body 1 may be directly made with one piece instead of the first insulative body 11 and the second insulative body 12 which are initially discrete from each other. Notably, because the insulative shield 4 and the insulative main body 1 both own somewhat flexibility, the protrusions 135 can be easily inserted into the corresponding securing holes 45. On one hand, compared with the traditional shield made of stamped sheet metal, the round mounting legs 422 are relatively stronger than the sheet/blade type mounting legs, thus assure superior and stable retention with the corresponding mounting apertures 202 in the PCB 200. On the other hand, the blade type mounting legs 301 of the shielding plate 3 are soldered within the corresponding soldering holes 204. Therefore, through cooperation of both the inner blade type mounting legs 301 of the metallic shielding plate 3 and the outer round mounting leg 422 of the insulative shield 4, the whole connector 1000 can be reliably, stably and easily mounted upon the PCB 200. Understandably, the round mounting legs 422 are located upon the insulative shield 4 instead of upon the insulative main body 1, thus preventing an external impact directly imposed upon the terminals 21 and 22 through the terminal module. The insulative shield 4 has different thicknesses on different positions so as to efficiently resist external impact upon different positions, compared with the traditional shield stamped from sheet metal.

However, the disclosure is illustrative only, changes may be made in detail, especially in matter of shape, size, and arrangement of sections within the principles of the invention.

What is claimed is:

1. An electrical connector assembly comprising:

a terminal module including:

an insulative main body having a rear mounting standing part and a front mating tongue part extending forwardly from the rear mounting standing part;

a plurality of terminals disposed in the insulative main body, via at least one insert-molding process, with corresponding contacting sections exposed upon the front mating tongue part; and an insulative shield assembled to the terminal module, and including a base and a tubular section extending forwardly from the base, wherein the base of the insulative shield forms a pair of downwardly extending mounting legs by two lateral sides of the terminal module for securing to an external printed circuit board (PCB) on which the insulative shield is positioned, further including a metallic shielding plate embedded within the insulative main body with a pair of soldering legs located between the pair of mounting legs in a transverse direction, wherein said mounting legs are round to snugly comply with a configuration of a corresponding mounting hole in the PCB while said soldering leg of the shielding plate is of a blade type, wherein said base is of an upside-down U-shaped configuration to cover the rear mounting standing part, wherein said tubular section further includes a pair of wings extending outwardly laterally on two lateral sides thereof, wherein said tubular section forms a pair of securing holes in opposite lateral sides to receive corresponding protrusions on the insulative main body so as to secure the terminal module to the insulative shield, wherein a waterproof plate is formed by glue around a root of said front mating tongue part, wherein said terminal module includes a first terminal module with a plurality of first terminals integrally formed within a first insulative body, and a second terminal module with a plurality of second terminals integrally formed within a second insulative body, said first insulative body being assembled with the second insulative body with a metallic shielding plate therebetween in a vertical direction, wherein said terminal module further includes a third insulative body applied thereon to complete the front mating tongue part, and said insulative shield is secured to the terminal module through said third insulative body.

2. An electrical connector assembly comprising:

a printed circuit board forming a cutout, a pair of large mounting holes located by two lateral sides of the cutout, and a pair of small mounting holes and a pair of soldering holes both located at a rear side of the cutout wherein said pair of soldering holes are located between the pair of small mounting holes in a transverse direction;

an electrical connector including:

a terminal module received within an insulative shield, said terminal module including a plurality of terminals and a metallic shielding plate integrally formed within an insulative main body via at least one insert-molding process, said insulative shield including a base and a tubular section extending from said base; wherein the tubular section is located within the cutout and the base is positioned upon the printed circuit board; wherein said base forms a pair of mounting legs extending through the corresponding small mounting holes, respectively, in a vertical direction, and said shielding plate forms a pair of soldering legs extending through the corresponding soldering holes, wherein the tubular section forms a pair of wings with corresponding large securing holes aligned with the pair of large mounting holes, respectively, in said vertical direction, wherein said terminal module includes a first terminal module and a second terminal module commonly sandwiching the shielding plate therebetween in the vertical direction, wherein said first terminal module includes a plurality of first terminals integrally formed within a first insulative body, and said second terminal module includes a plurality of second terminals integrally formed within a second insulative body, and a third insulative body applied upon both said first terminal module and said second terminal module, wherein the insulative main body of the terminal module forms a protrusion, and the insulative shield forms a securing hole to receive said protrusion for securing the terminal module within the insulative shielding, wherein a waterproof plate is formed in the terminal module around a boundary between the tubular section and the base, wherein said mounting legs are of a round type while said soldering legs are of a blade type.

3. An electrical connector for securing to a printed circuit board, comprising:

a terminal module including:

an insulative main body having a rear mounting standing part and a front mating tongue part extending forwardly from the rear mounting standing part;

a plurality of terminals and a metallic shielding plate commonly disposed in the insulative main body, via at least one insert-molding process, with corresponding contacting sections exposed upon the front mating tongue part, and with a pair of soldering legs extending downwardly from a rear region of the shielding plate; and an insulative shield assembled to the terminal module, and including a base and a tubular section extending forwardly from the base, wherein the base of the insulative shield forms a pair of downwardly extending mounting legs for mounting to an external printed circuit board (PCB) on which the insulative shield is positioned; wherein said mounting legs are of a round type while said soldering legs are of a blade type, wherein said tubular section forms a pair of outwardly and laterally extending wings with corresponding securing holes, said holes are diametrically larger than the mounting legs, wherein the insulative shield forms a securing hole to receive a protrusion of the insulative main body for securing the terminal module and the insulative shield together, wherein a waterproof plate is disposed in the terminal module and located adjacent to a boundary between the tubular section and the base.

* * * * *